United States Patent [19]

Ikeda et al.

[11] Patent Number: 4,882,311

[45] Date of Patent: Nov. 21, 1989

[54] HEAT-SENSITIVE RECORDING MATERIAL

[75] Inventors: Kenji Ikeda; Ken Iwakura; Masanobu Takashima, all of Shizuoka, Japan

[73] Assignee: Fuji Photo Film Co., Ltd., Kanagawa, Japan

[21] Appl. No.: 11,806

[22] Filed: Feb. 6, 1987

[30] Foreign Application Priority Data

Feb. 6, 1986 [JP] Japan ..... 61-24493

[51] Int. Cl.[4] ..... B41M 5/18

[52] U.S. Cl. ..... 503/208; 427/150; 427/151; 428/913; 503/209; 503/225

[58] Field of Search ..... 503/208, 209, 225; 427/150–152; 428/913, 914

[56] References Cited

U.S. PATENT DOCUMENTS

| | | | |
|---|---|---|---|
| 4,531,140 | 7/1985 | Suzuki et al. | 503/208 |
| 4,538,164 | 8/1985 | Takigawa et al. | 503/208 |
| 4,628,335 | 10/1986 | Igarashi et al. | 503/208 |

*Primary Examiner*—Bruce H. Hess

*Attorney, Agent, or Firm*—Sughrue, Mion, Zinn, Macpeak & Seas

[57] ABSTRACT

A heat-sensitive recording material is disclosed. The material comprises a support having provided thereon a heat-sensitive color forming layer containing an electron donating dye precursor and an electron accepting compound, said heat-sensitive color forming layer containing at least one compound selected from an aromatic polyether and an aromatic polyester, and an aromatic ether.

5 Claims, No Drawings

HEAT-SENSITIVE RECORDING MATERIAL

FIELD OF THE INVENTION

The present invention relates to a heat-sensitive recording material, and more particularly it relates to a heat-sensitive recording material which is prepared by using an electron donating dye precursor and an electron accepting compound.

BACKGROUND OF THE INVENTION

A heat-sensitive recording material using an electron donating dye precursor and an electron accepting compound is disclosed in Japanese Patent Publication Nos. 14039/70; (corresponding to U.S. Pat. No. 3,539,375) and 4160/68. This heat-sensitive recording material is required essentially to have such properties that (1) color forming density and color forming sensitivity should be sufficient, (2) fog, which is the color forming phenomenon occurring during the storage of unused heat-sensitive recording materials, should not occur and that (3) color fastness, after color is formed, should be sufficient. However at present, satisfactory heat-sensitive recording material meeting the above-described requirements has not yet been obtained.

Particularly with recent demand for much higher speed recording by a heat-sensitive recording system, research as to the above-described (1) has been extensively developed.

As one approach to satisfying the above requirement (1), it has been suggested that the melting point of an electron accepting compound itself is to be raised from 60° C. to 100° C. However, it is difficult to adjust the melting point of phenol compounds which are most widely used as an electron accepting compound and, further, those phenol compounds are costly and thus are not practical.

As another approach, it is disclosed in Japanese Patent Publication Nos. 17748/74 and 39567/76 that organic acids and phenol compounds are used in combination, or polyvalent metal salts of compounds having alcoholic hydroxy groups are used as an electron accepting compound. As still another approach, it is disclosed in Japanese Patent Publication No. 29945/76 that a copolymer of hydroxyethyl cellulose and maleic anhydride is used as an electron accepting compound.

It is also disclosed in Japanese Patent Publication No. 27599/76 and Japanese Patent Application (OPI) No. 19231/73 (the term "OPI" as used herein means an "unexamined published application") that waxes are added.

It is further disclosed that in order to increase color sensitivity, a nitrogen containing compound such as acetoamide, stearoamide and the like (Japanese Patent Application (OPI) No. 34842/74), acetoacetic anilide (Japanese Patent Application (OPI No. 106746/77), N,N-diphenylamine and benzamide derivatives (Japanese Patent Application (OPI) No. 11036/78), alkylated biphenyl and biphenyl alkane (Japanese Patent Application (OPI) No. 39139/78) and p-hydroxybenzoate derivative (Japanese Patent Application (OPI) No. 144193/81) are incorporated into a heat-sensitive color forming layer.

It is disclosed that into a heat-sensitive color forming layer, fatty acid amide wax is added (Japanese Patent Application (OPI) No. 115554/74), di-β-naphthyl-p-phenylene diamine is added (Japanese Patent Application (OPI) No. 149353/75), and carboxylic acid ester such as benzoin, dimethyl isophthalate or diphenyl phthalate is added (Japanese Patent Application (OPI) No. 5636/78).

It is known that naphthol derivatives such as β-naphthol benzyl ether, α-naphthol benzyl ether and the like and naphthoic acid derivatives such as phenyl α-hydroxy-β-naphthoate are used as an sensitizing agent to increase the color forming sensitivity.

Among the above-described approaches, a method of using β-naphthol-benzyl ether derivatives as a sensitizing agent and a method of using p-hydroxybenzoate as an electron accepting compound are the most effective.

However, the heat-sensitive recording material prepared by using the above-described compounds has such defects that color formed images disappear with passage of time (density decay) and that white powders appear on the surface of images (breeding).

SUMMARY OF THE INVENTION

An object of the present invention is to provide a heat-sensitive recording material having sufficient color forming density and color forming sensitivity and excellent stability with passage of time.

DETAILED DESCRIPTION OF THE INVENTION

The object of the present invention can be attained by a heat-sensitive recording material comprising a support having provided thereon a heat-sensitive color forming layer containing an electron donating dye precursor and an electron accepting compound, wherein said heat-sensitive color forming layer contains at least one compound selected from the group consisting of an aromatic polyether and an aromatic polyester, and an aromatic ether.

As aromatic polyether or aromatic polyester used in the present invention, the compounds represented by formula (I) are preferred.

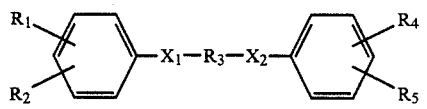

(I)

wherein $R_1$, $R_2$, $R_4$ and $R_5$ may be the same or different, and each represents a hydrogen atom, an alkyl group, an alkoxy group, an aryloxy group, an acyl group, a halogen atom, a cyano group, an aryl group, an alkyloxycarbonyl group or an aryloxycarbonyl group, wherein the pair $R_1$ and $R_2$ and the pair $R_4$ and $R_5$ may combine to form a ring structure. $R_3$ represents an alkylene group having from 1 to 5 ether bonds or ester bonds, and having from 1 to 10 carbon atoms, or represents

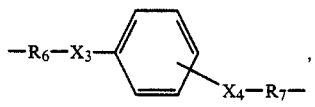

wherein $R_6$ and $R_7$ represent an alkylene group having from 1 to 8 carbon atoms, $X_3$ and $X_4$ each represents -O- or -S-. $X_1$ and $X_2$ represent -O-, -S- or $$-\underset{\underset{O}{\|}}{C}-O-,$$

and $X_1$ and $X_2$ may be the same or different.

As aromatic ether, particularly as aromatic monoether or aromatic diether, the compounds represented by formulae (II) and (III) are preferred.

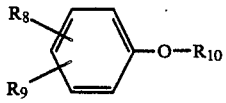

(II)

wherein $R_8$ and $R_9$ are each defined the same as $R_1$ above, wherein $R_8$ and $R_9$ may combine to form a ring structure. $R_{10}$ represents a substituted or unsubstituted alkyl, a substituted or unsubstituted aralkyl or a substituted or unsubstituted aryl and,

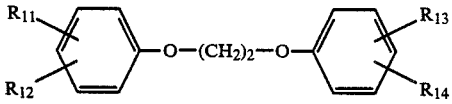

(III)

wherein $R_{11}$, $R_{12}$, $R_{13}$ and $R_{14}$ are each defined the same as $R_1$, wherein $R_{11}$ and $R_{12}$, and $R_{13}$ and $R_{14}$ may combine to form a ring structure.

In the compounds represented by formula (I), those compounds having a melting point in the range of from 90 to 200° C are preferred.

In the compounds represented by formulae (II) and (III), those compounds having a melting point in the range of from 60° to 150° C. are preferred, and more particularly those compounds having a melting point in the range of from 90° C. to 130° C. are preferred.

The additive amount of the compounds represented by formula (I) is preferably from 5 to 90 wt%, more preferably from 20 to 80 wt% based on the electron accepting compound of the present invention.

The additive amount of the compounds represented by formulae (II) and (III) is preferably in the range of from 10 to 200 wt %, more preferably from 50 to 150 wt % based on the amount of electron accepting compounds of the present invention.

The mixing ratio of the compounds represented by formula (I), to the compounds represented by formula (II) and (III) [(I)/((II) or (III))]is preferably in the range of from 0.1 to 0.9, more preferably in the range of from 0.2 to 0.7.

Specific examples of the compounds represented by formulae (I), (II) and (III) are shown below. These examples are meant to be exemplary and should, therefore, not be interpreted as limiting upon the spirit and scope of the invention as generally disclosed herein.

(1) Examples of compounds represented by formula (I):

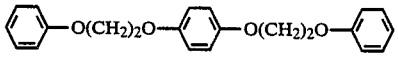

(1)

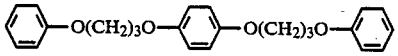

(2)

-continued

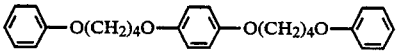

(3)

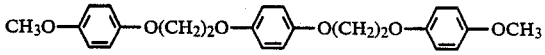

(4)

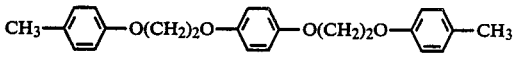

(5)

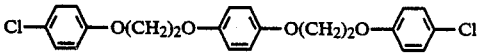

(6)

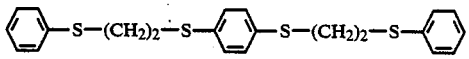

(7)

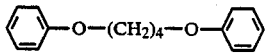

(8)

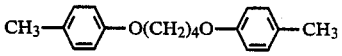

(9)

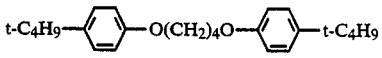

(10)

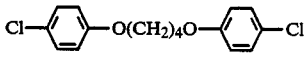

(11)

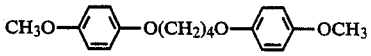

(12)

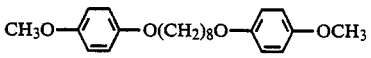

(13)

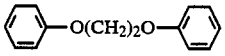

(14)

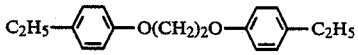

(15)

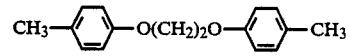

(16)

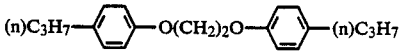

(17)

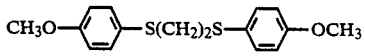

(18)

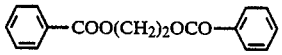

(19)

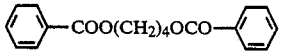

(20)

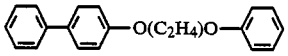

(21)

(2) Examples of compounds represented by formula (II):

(22)

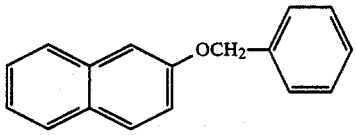

(23)

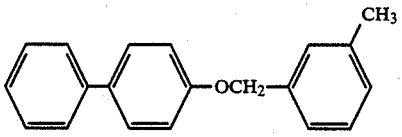

(24)

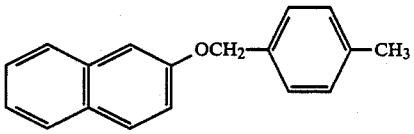

(25)

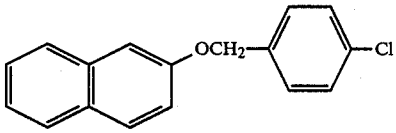

(26)

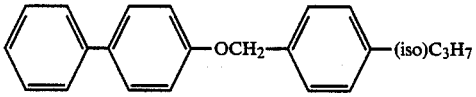

(3) Examples of compounds represented by formula (III):

(27)

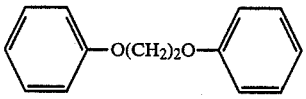

(28)

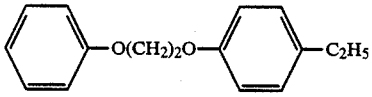

(29)

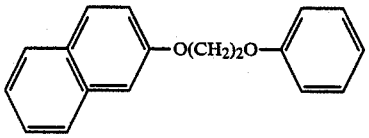

(30)

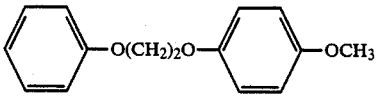

(31)

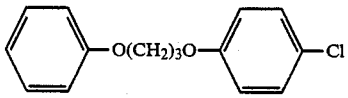

(32)

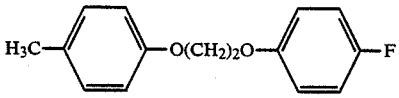

-continued (33)

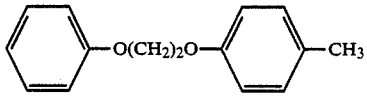

(34)

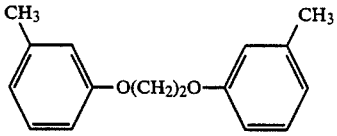

When said aromatic ethers are selected from among compounds represented by formula (III), $R_3$ of the compounds represented by formula (I) is preferably

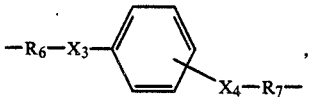

wherein $R_6$, $R_7$, $X_3$ and $X_4$ are defined the same as above.

A method for preparing a heat-sensitive recording material of the present invention is explained below.

It is preferred that the above-described compounds used in the present invention are dispersed with an electron accepting compound by a dispersing device such as a ball mill in a solution of high molecular weight compounds to make the particle size of from 0.1 to 10 μm and thereafter mixed with an electron donating dye precursor.

The heat-sensitive recording material of the present invention is prepared by dispersing an electron donating dye precursor (hereinafter referred to as "color coupler") and an electron accepting compound (hereinafter referred to as "developer") which has been dispersed with the above-described aromatic polyether, polyester, or ether by a means of a ball mill, a sand mill, an attritor, and a three roll mill respectively in an aqueous solution of water-soluble high molecular weight compounds to make an average particle size of from 0.1 to 10 μm.

The color coupler and the developer are dispersed separately and then mixed together to prepare a coating composition. A colorless or slightly colored oil absorbing pigment, wax dispersion, a releasing agent and the like can be added thereto, if necessary.

The color couplers used in the present invention include triarylmethane compounds diphenylmethane compounds, xanthen compounds, thiazine compounds and spiropyran compounds. Specific examples thereof include:

(1) Triarylmethane compounds such as 3,3-bis(p-dimethylaminophenyl)-6-dimethylaminophthalide (that is, crystal violet lactone), 3,3-bis(p-dimethylam:inophenyl)phthalide, 3-(p-dimethylaminophenyl)-3-(1,3-dimethylindol-3-yl)phthalide, 3-(p-dimethylaminophenyl)-3-(2-methylindol-3-yl)phthalide;

(2) Diphenylmethane compounds such as 4,4'-bis-dimethylaminobenzhydrin benzyl ether, N-halophenyl-leucoauramine, N-2,4,5-trichlorophenyl leucoauramine;

(3) Xanthen compounds such as rhodamine-B-anilinolactam, rhodamine(p-nitroanilino)lactam, rhodamine B(p-chloroanilino)lactam, 2-di-benzylamino-6-diethylaminofluoran, 2-ani- lino-6-diethylaminofluoran, 2-anilino-3-methyl-6-diethylaminofluoran, 2-anilino-3-methyl-6-cyclohexyl methylaminofluoran, 2-o-chloroanilino-6-diethylaminofluoran, 2-m-chlo- roanilino-6-diethylaminofluoran, 2-(3,4-dichloroanilino)-6-diethylaminofluoran, 2-octylamino-6-diethylaminofluoran, 2-di-hexylamino 6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-n'ethyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2 anilino-3-methyl-6-N-ethylN-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluoran;

(4) Thiazine compounds such as benzoylleucomethylene blue, and p-nitrobenzylleucomethylene blue; and (5) Spiro compounds such as 3-methyl-spiro-dinaphthopyran, 3-ethyl-spiro-dinaphthopyran, 3,3'-dichloro-spiro-dinaphthopyran, 3-benzylspiro-dinaphthopyran, 3-methyl-naphtho-(3-methoxybenzo)spiropyran and 3-propyl-spiro-dibenzopyran.

These compounds can be used alone or in combination.

The developers of the present invention include phenol compounds, organic acids and the metal salts thereof, hydroxybenzoate, and the like. Phenol compounds are particularly preferred, since the additive amount thereof is small. Among those compounds, bisphenol compounds, benzyl 4-hydroxybenzoate and dimethyl 4-hydroxyphthalate are preferred.

Those compounds are disclosed, for example, in Japanese Patent Publication No. 14039/70 and 29830/76. Specific examples thereof are 4-tertiary-butylphenol, 4-phenylphenol, 4-hydroxydiphenoxide, α-naphthol, β-naphthol, methyl-4-hydroxybenzoate, 2,2'-dihydroxybiphenyl, 2,2-bis(4-hydroxyphenyl)propane (bisphenol A), 4,4'-isopropylidenebis(2-methylphenol), 1,1-bis-(3-chloro-4-hydroxyphenyl)cyclohexane, 1,1-bis-(3-chloro-4-hydroxyphenyl)-2-ethylbutane, 4,4'-secondary-isobutylidenediphenol, 1,1-bis-(4-hydroxyphenyl)-cyclohexane, benzyl 4-hydroxybenzoate, m-chlorobenzyl 4-hydroxybenzoate, β-phenethyl 4-hydroxybenzoate, 4-hydroxy2',4'-dimethylphenylsulfone, 1-t-butyl-4-p-hydroxyphenylsulfonyloxybenzene, 4-N-benzylsulfamoyl phenol, p-methylbenzyl 2,4-dihydroxybenzoate, β-phenoxyethyl 2,4-dihydroxybenzoate, and benzyl 2,4-dihydroxy-6-methylbenzoate.

The oil absorbing pigments include calcium carbonate, aluminium hydroxide, barium carbonate, barium sulfate, talc, agalmatolite, kaolin, calcined kaolin, zinc oxide, diatomaceous earth, amorphous silica, lithopon, titanium oxide, urea-formaldehyde resin filler, and polyethylene filler.

Examples of wax include polyethylene wax, paraffin wax, microcrystalline wax and carnauba wax.

The releasing agents are preferably metal salts of higher fatty acids, such as zinc stearate, aluminum stearate, or calcium stearate.

Upon dispersing couplers and developers, a water soluble high molecular compound is added as a protective colloid. As a water soluble high molecular compound, those that can dissolve in water of 25° C. by 5% or more are preferred, such as methyl cellulose, carboxy methyl cellulose, hydroxyethyl cellulose, starches, gelatin, gum arabic, casein, a salt of a copolymer of styrene and maleic anhydride, a salt of a copolymer of ethylene and maleic anhydride, a salt of a copolymer of isobutylene and maleic anhydride, polyvinyl alcohol, and carboxy-modified polyvinyl alcohol. These water soluble high molecular compounds serve as a binding agent when a heat-sensitive material is coated on a support.

The thus prepared coating composition is coated on a support, e.g., a base paper, by a conventional coating method, for example, a bar coating method, a blade coating method, or a gravure coating method, and the like, dried, and subjected to calendering treatment, if necessary.

The preferred coating amount is 3 to 20 g/m$^2$, more preferably 4 to 8 g/m$^2$ by solid content.

As a support, a coated paper, a synthetic paper, and the like which are very similar to an ordinary paper, can be also used.

The present invention will be explained in more detail by the following Examples. These examples are intended to be exemplary and should not be interpreted as limiting upon the spirit and scope of the present invention as generally disclosed herein.

EXAMPLES 1 TO 8

As a color coupler, 10 parts by weight of 2-anilino-3-methyl-6-diethylaminofluoran was dispersed with 50 parts by weight of 5% polyvinyl alcohol (saponification degree: 98%, degree of polymerization: 500) in a ball mill for a day and a night to prepare a dispersion of a color coupler (A).

As a developer, 20 parts by weight of 2,2-bis(4-hydroxyphenyl)propane was dispersed with 5 parts by weight of compounds (I) of the present invention, and 10 parts of compounds (II) or (III) which are shown in Table 1, and with 200 parts by weight of 5% polyvinyl alcohol in a ball mill for a day and a night to prepare a dispersion (B).

40 parts by weight of calcium carbonate ("Brilliant-15", a trade name, manufactured by Shiraishi Kogyo Co., Ltd.) was mixed with 40 parts by weight of 1% sodium hexametaphosphate and was dispersed by a homogenizer to prepare a dispersion (C).

The dispersions (A), (B), and (C) were mixed and then 10 parts by weight of a dispersion of 20% zinc stearate and 10 parts by weight of a dispersion of 20% paraffin wax were added thereto and stirred sufficiently to prepare a coating composition for a heat-sensitive recording layer.

The coating composition was coated on a high quality paper having weighing capacity of 50 g/m$^2$ by a wire bar so that the coating amount was 5 g/m$^2$ by solid content and was dried at 50° C. for 2 minutes to obtain a heat-sensitive recording paper.

EXAMPLES 9 AND 10

The same procedure as in Examples 1 to 2 were repeated to prepare a heat-sensitive recording paper except that benzyl p-oxybenzoate was used instead of 2,2-bis(4-hydroxyphenyl)propane.

COMPARATIVE EXAMPLE 1

The same procedure as in Example 1 was repeated to prepare a heat-sensitive recording paper except that compounds of the present invention were removed.

COMPARATIVE EXAMPLE 2

The same procedure as in Example 9 was repeated to prepare a heat-sensitive recording paper except that compounds of the present invention were removed.

TABLE 1

| Example No. | Compounds of formula (I) | Compounds of formula (II) or (III) |
|---|---|---|
| 1. and 9. | 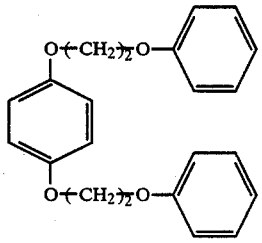 mp. 184~5° C. | 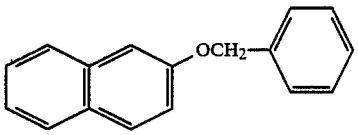 mp. 100~102° C. |
| 2. and 10. | 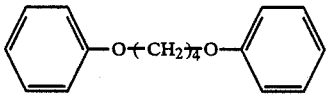 mp. 97° C. | 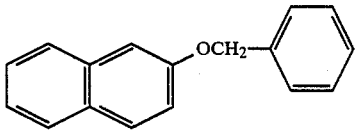 |
| 3. | 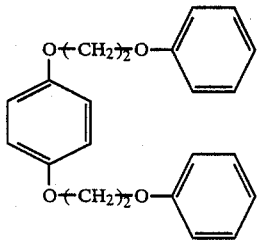 | 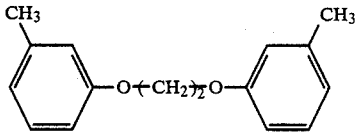 mp. 97° C. |
| 4. | 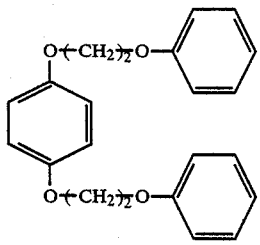 | 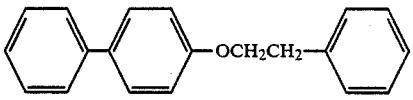 mp. 96° C. |
| 5. | 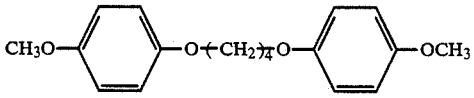 mp. 143° C. | 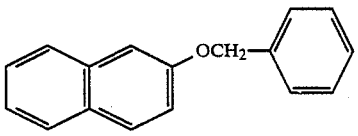 |
| 6. | 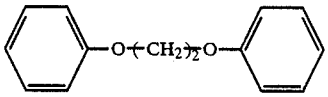 mp. 96° C. | 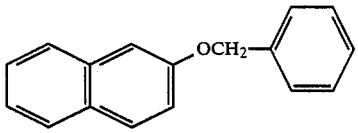 |

TABLE 1-continued

| Example No. | Compounds of formula (I) | Compounds of formula (II) or (III) |
|---|---|---|
| 7. | 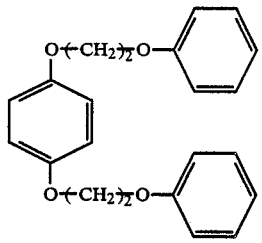 | 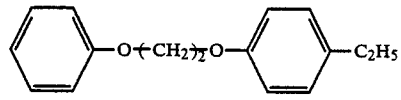 mp. 106° C. |
| 8. | 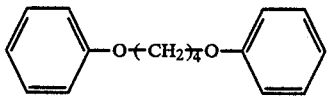 | 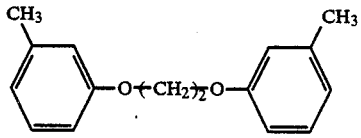 |

COMPARATIVE TEST

(1) Fog and color forming property

Recording was carried out on the heat-sensitive recording papers obtained in Examples and Comparative Examples by giving 2 ms/dot and energy of 50 mJ/m$^2$ with densities of 5 dot/mm of main scanning and 6 dot/mm of sub scanning to a recording device, and then fog (density before recording) and color forming density after recording (initial density) were measured by Macbeth RD-514 type reflective densitometer equipped with a visual filter.

(2) Moisture resistance

Color formed papers obtained by the color forming test were allowed to stand for 24 hours under the atmosphere of 40° C. and relative humidity (RH) 90%, and thereafter fog (density of background) and the density of formed color were measured. The residual ratio of formed color was calculated by the following formula.

$$\frac{\text{Density of formed color having undergone moistured condition}}{\text{initial density}} \times 100$$

(3) Heat resistance

Color formed papers obtained by the color forming test were allowed to stand under the atmosphere of 60° C. and RH 30% for 24 hours, and then fog (density of background) and the density of formed color were measured. The residual ratio of formed color was calculated by the following formula.

$$\frac{\text{Density of formed color having undergone heated condition}}{\text{initial density}} \times 100$$

(4) Test of storage stability with time passage (white powder)

A test chart No. 8 made by The Image Electronic Society was copied by a heat-sensitive facsimile ("Nefax-22", a trade name, manufactured by Nippon Electric Co., Ltd.). After color was formed, the copy was allowed to stand under atmosphere of 20° C. and RH 60% for 24 hours. Then whether white powder came out or not was checked.

Evaluation was made under three criteria:

(1) A means the case where white powder did not come out at all;

(2) B means the case where white powder came out, but negligible for practical use; and (3) C means the case where white powder came out and unfavorable for practical use. The results are shown in Table 2.

TABLE 2

| | Density | | Moisture Resistance | | Heat Resistance | | |
|---|---|---|---|---|---|---|---|
| Example No. | Formed Color | Fog | Residual Ratio | Fog | Residual Ratio | Fog | White Powder |
| Example 1 | 1.09 | 0.06 | 88.5 | 0.08 | 89.1 | 0.10 | A |
| Example 2 | 1.10 | 0.07 | 90.0 | 0.08 | 91.5 | 0.11 | A |
| Example 3 | 1.09 | 0.07 | 92.3 | 0.09 | 93.0 | 0.10 | A |
| Example 4 | 1.12 | 0.07 | 90.1 | 0.09 | 92.0 | 0.10 | A |
| Example 5 | 1.10 | 0.07 | 89.0 | 0.08 | 95.0 | 0.10 | A |
| Example 6 | 1.15 | 0.06 | 92.1 | 0.07 | 94.0 | 0.09 | A |
| Example 7 | 1.12 | 0.07 | 91.5 | 0.09 | 92.3 | 0.10 | A |
| Example 8 | 1.13 | 0.07 | 89.1 | 0.09 | 89.9 | 0.09 | A |
| Example 9 | 1.16 | 0.06 | 88.5 | 0.07 | 91.5 | 0.09 | A |
| Example 10 | 1.12 | 0.07 | 92.0 | 0.08 | 90.0 | 0.10 | A |
| Comparative Example 1 | 1.10 | 0.08 | 86.3 | 0.09 | 79.0 | 0.14 | C |
| Comparative Example 2 | 1.15 | 0.09 | 70.0 | 0.15 | 80.5 | 0.11 | C |

From the above results, it is apparent that the heat-sensitive recording paper of the present invention exhibits sufficient color forming density and has no problems as to disappearance of color with passage of time and appearance of white powder.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a heat-sensitive color forming layer containing an electron donating dye precursor and an electron accepting compound, said heat-sensitive color forming layer containing (1) at least one compound selected from the group consisting of an (a) aromatic polyether and (b) aromatic polyester, and (2) an aromatic ether, wherein said aromatic ether is other than said aromatic polyether, wherein said aromatic polyether and aromatic polyester is selected from the group consisting of compounds represented by formula (I):

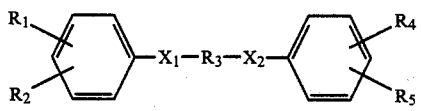

(I)

wherein $R_1$, $R_2$, $R_4$ and $R_5$ may be the same or different, and each represents hydrogen, alkyl, alkoxy, aryloxy, acyl, halogen, cyano, aryl alkyloxycarbonyl or aryloxycarbonyl, wherein the pair $R_1$ and $R_2$ and the pair $R_4$ and $R_5$ may each combine and form a ring structure.

$R_3$ represents an alkylene group having 1 to 5 ether bonds or ester bonds and having from 1 to 10 carbon atoms, or represents

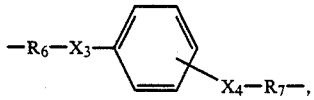

wherein $R_6$ and $R_7$ each represents an alkylene group having from 1 to 8 carbon atoms, $X_3$ and $X_4$ each represents -O-, or -S-, and $X_1$ and $X_2$ may be the same or different and each represents -O-, -S- or

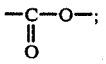

and wherein said aromatic ether is an aromatic monoether represented by formula (II)

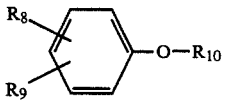

(II)

wherein $R_8$ and $R_9$ are each defined the same as $R_1$ above, wherein $R_8$ and $R_9$ can combine to form a ring structure, and $R_{10}$ represents a substituted or unsubstituted alkyl, substituted or unsubstituted aralkyl, or substituted or unsubstituted aryl.

2. A heat-sensitive recording material as defined in claim 1, wherein the compounds represented by formula (I) have a melting point in the range of from 90° C. to 200° C.

3. A heat-sensitive recording material as defined in claim 2, wherein the compounds represented by formula (II) have a melting point in the range of from 60° C. to 150° C.

4. A heat-sensitive recording material as defined in claim 1, wherein the additive amount of compounds represented by formula (II) is in the range of from 10 to 200 wt % based on the amount of said electron accepting compound.

5. A heat-sensitive recording material as defined in claim 4, wherein the mixing ratio of the compounds represented by formula (I) to the compounds represented by formula (II) is in the range of from 0.1 to 0.9.

* * * * *